US009468833B1

(12) United States Patent
Foos

(10) Patent No.: US 9,468,833 B1
(45) Date of Patent: Oct. 18, 2016

(54) GOLF TRAINING AID FOR PUTTING

(71) Applicant: William F. Foos, Camp Hill, PA (US)

(72) Inventor: William F. Foos, Camp Hill, PA (US)

( * ) Notice: Subject to any disclaimer, the term of this patent is extended or adjusted under 35 U.S.C. 154(b) by 0 days.

(21) Appl. No.: 14/980,177

(22) Filed: Dec. 28, 2015

Related U.S. Application Data

(60) Provisional application No. 62/099,216, filed on Jan. 2, 2015.

(51) Int. Cl.
*A63B 69/36* (2006.01)

(52) U.S. Cl.
CPC .... *A63B 69/3676* (2013.01); *A63B 2208/0204* (2013.01)

(58) Field of Classification Search
USPC ..... 473/174–180
See application file for complete search history.

(56) References Cited

U.S. PATENT DOCUMENTS

| | | | | |
|---|---|---|---|---|
| 3,434,721 | A * | 3/1969 | Travers | A63B 57/357 273/127 R |
| D349,321 | S * | 8/1994 | Eversole | D21/790 |
| 7,914,387 | B1 * | 3/2011 | Gugliotti | A63B 67/02 473/173 |
| 8,177,233 | B2 * | 5/2012 | Grayson | A63B 63/08 273/118 R |
| 9,327,176 | B1 * | 5/2016 | Goserud | A63B 69/3676 |
| 2002/0173366 | A1 * | 11/2002 | Lister | A63B 67/02 473/174 |
| 2006/0135275 | A1 * | 6/2006 | Kramer | A63B 69/3676 473/174 |

OTHER PUBLICATIONS

"Putt Pocket® at SKLZ", http://shop.sklz.com/putting/putt-pocketr/invt/pat0100004, visited Dec. 3, 2015, 8 pages.

* cited by examiner

*Primary Examiner* — Nini Legesse
(74) *Attorney, Agent, or Firm* — Hooker & Habib, P.C.

(57) ABSTRACT

A golf training aid for putting has a retainer that is received in a regulation-size golf hole to position a fence against the putting surface. The fence extends away from opposite sides of the golf hole and is curved to bounce golf balls that impact the fence towards the golf hole.

6 Claims, 3 Drawing Sheets

GOLF TRAINING AID FOR PUTTING

RELATED APPLICATION

This application claims priority from my U.S. Provisional Patent Application No. 62/099,216 "Golf Training Aid" filed Jan. 2, 2015, which priority application is incorporated by reference as if fully set forth herein.

FIELD OF THE DISCLOSURE

The disclosure relates generally to golf training aids, and more specifically, golf training aids for putting.

BACKGROUND OF THE DISCLOSURE

The aim of the game of golf is to go from the tee to the golf hole in the fewest number of strokes. The phrase "drive for show and putt for dough" emphasizes the importance of putting in scoring a good round of golf.

Golf holes in accordance with golf's recognized governing bodies have an outside diameter of 4¼ (four and one-quarter) inches or 108 millimeters. The hole must be at least 4 inches or 100 millimeters deep. A golf cup is placed in the golf hole to support the wall of the golf hole and to receive the flagstick. The top of the golf cup is at least one inch below the top of the golf hole so as to not reduce the effective diameter of the golf hole.

In the United States, a regulation golf ball has a diameter not more than 1.68 inches or 42.7 millimeters. In Europe, a regulation golf ball has a diameter not more than 1.62 inches or 41.1 millimeters.

Practicing putting by putting a regulation golf ball into a regulation golf hole is a key to improved scoring. Practicing putting translates to greater putting success and greater enjoyment of the game.

There are a number of golf training aids available for putting practice. An example is the PUTT POCKET training aid that includes a horseshoe-shaped body that is placed over the golf hole. The body reduces the effective diameter of the golf hole and has an opening between the ends of the horseshoe that is sized to closely receive a golf ball. The small opening allows only putts approaching the golf hole from a very narrow approach angle to pass through the body and to the golf hole.

Although the PUTT POCKET training aid is useful for improving putting accuracy, many new and weekend golfers are frustrated by the many missed putts. And even near misses roll past the training aid and cannot be putted back to the hole without re-aligning the body, further increasing user frustration.

There is a need for a golf training aid that makes practicing putting with a regulation golf ball and regulation golf hole easier and more enjoyable.

SUMMARY OF THE DISCLOSURE

Disclosed is a golf training aid for practicing putting on a putting surface having a conventional regulation-sized golf hole defined by an annular wall. The golf training aid includes a retainer, a fence, and a rail connecting the retainer and fence together.

The retainer is sized to be removably insertable into the golf hole to locate the fence against the putting surface. The fence is next to a side of the golf hole and extends away in opposite directions from the golf hole when the retainer is positioned in the golf hole.

The fence includes a face having a width dimension and a height dimension perpendicular to the width dimension. The width dimension is greater than the diameter of the standard, regulation-sized golf hole. the width dimension and may be more than three times the diameter of the standard regulation-sized golf hole so that when the golf hole is centered along the fence, the fence extends away more than the diameter of the golf hole from each of the opposite sides of the golf hole.

The fence therefore does not reduce the effective diameter of the golf hole when the golf ball is putted on a line centered on the golf hole that passes through the center of the fence, and in embodiments, allows putts to enter the golf hole from a relatively large intake angle that in embodiments may be more than 90 degrees.

When the retainer is in the operating position, the fence is against the putting surface with the height dimension of the fence face extending away from the putting surface, and with the width dimension of the fence face extending away from opposite sides of the golf hole. This enables a golf ball putted toward the fence face that misses the golf hole to strike the fence face and not roll past the hole.

In an embodiment, the fence face is curved along the width dimension and defines a concave fence face. The fence face includes three points defining a circle having a diameter substantially greater than the diameter of the regulation golf hole that the retainer is designed for, that is, the radius of curvature of the fence face along the width is at least twice the radius of curvature of the regulation golf hole). Golf balls rebounding off the fence face bounce towards the golf hole to increase the odds of the golf ball going into the hole. Although the person putting the ball realizes the putt would have missed, seeing the golf ball go into the hole still provides positive feedback and encouragement—the closer the miss, the more likely the ball bouncing off the fence and into the hole.

In a variant embodiment, panels are mounted to the fence face that enables the width of the fence face to be selectively increased or decreased. Beginners might use the disclosed training aid with the fence at full width, while more skilled players might use the disclosed training aid with the fence at a minimum width.

In a further possible embodiment, the fence face is curved along the height dimension and has a radius of curvature greater than the radius of the golf ball. It has been found that having a concave curve in the height direction also helps direct the rebounding ball towards the golf hole.

The disclosed golf training aid is easy to set up and remove. Placing the retainer in the golf hole is easy and quick, requiring no special tools or assembly skills. In a possible embodiment the retainer has sufficient inherent flexibility to compress and be received within the golf cup. The retainer helps support the fence against the putting surface, and resists deformation of the fence caused by golf ball impact. Impact forces are transmitted to ground by the retainer through the annular wall of the golf hole, allowing the fence to appear "free standing" on the putting green during use. The wide fence reduces frustration and helps provide positive feedback.

Other objects and features of the disclosure will become apparent as the description proceeds, especially when taken in conjunction with the accompanying drawing sheets illustrating one or more illustrative embodiments.

DETAILED DESCRIPTION

Figure 1:
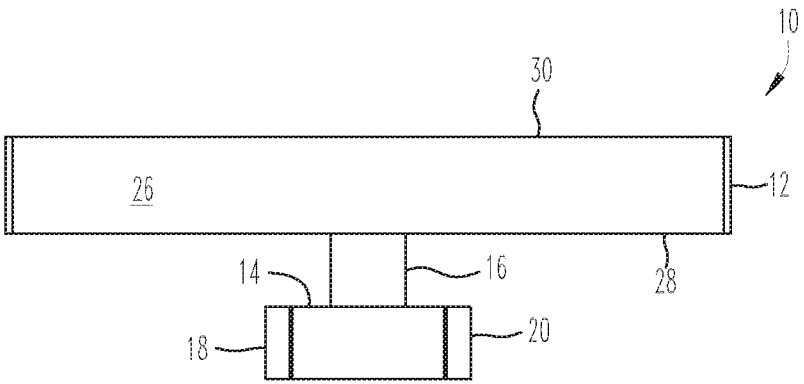
FIGS. 1-3 are front, top, and side views respectively of a first embodiment golf training aid.
Figure 2:
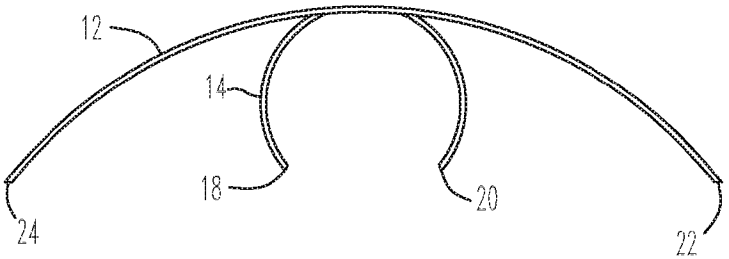
Figure 3:
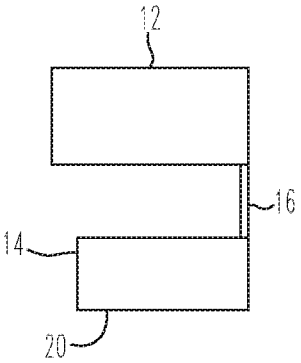

FIGS. 1-3 illustrate a first embodiment golf training aid 10 for putting. The training aid 10 is made from molded plastic and includes a fence 12, a retainer 14, and a rail 16 connecting the retainer to the fence. The fence 12 is attached to an upper portion of the rail 16. The retainer 14 is attached to a lower portion of the rail 16.

The retainer 14 is sized to be removably insertable into a regulation golf hole. The illustrated retainer 14 is essentially shaped as a partial circle having an outer radius in the illustrated embodiment of 2.06 inches, enabling the retainer 14 to be closely received within a regulation-diameter golf hole. The retainer 14 has two curved arms 18, 20 extending away from the rail 16. The free ends of the arms 18, 20 are spaced apart a distance slightly greater than the diameter of a conventional flagstick to enable the flagstaff to be received between the arms. When the retainer 14 is inserted into the golf hole, the arms 18, 20 and the rail 16 cooperate to support the golf training aid 10 in an upright position for use while practicing putting as shown in FIG. 4.

The illustrated fence 12 is a curved member that extends along a circular arc having a radius of about ten and one-half inches from a first end 22 to a second end 24, the fence 24 subtending a circular arc of about 128 degrees. The chord width of the fence 12 between the ends 22, 24 is about 20.2 inches. The fence 12 allows a golf ball to approach a golf hole through an included angle of about 154 degrees, as represented by the included angle 25*a* defined by the two phantom lines 25*b*, 25*c* that would extend from the center of a golf hole when the training aid 10 is being used for putting practice.

The fence 12 has a concave face 26 that in use faces the golf hole. The face 26 extends in the height direction from a lower fence end 28 to an upper fence end 30 a distance somewhat greater than the diameter of a regulation golf ball.

Figure 4:
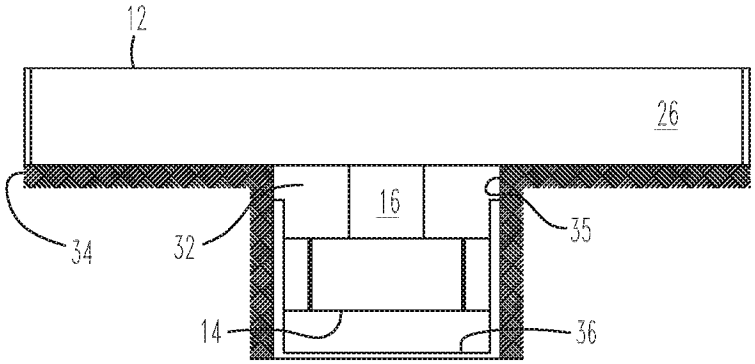
FIG. 4 illustrates the golf training aid shown in FIGS. 1-3 inserted into a golf hole for use.

FIG. 4 illustrates the training aid 10 with the retainer 14 inserted into a regulation-sized golf hole 32 located on a putting green 34 and defined in part by an annular wall 35. A conventional golf cup 36 has been inserted into the golf hole 32. The golf cup 36 is shown in simplified form in FIG. 4, it being understood the golf cup 36 may include drainage holes, a hole to receive the flag, and other conventional elements. The retainer arms 18, 20 have sufficient inherent elasticity and flexibility to be compressed slightly towards one another to place the retainer 14 inside the golf cup 36. If a flagstick is present, the flagstick is received between the arms 18, 20 to locate the retainer 14 above the golf hole 34 before being inserted into the golf hole.

Releasing the arms 18, 20 generates an interference fit or a close fit between the retainer 14 and the golf cup 36 that supports the rail 16 extending vertically upright out of the golf hole 32. The lower end of the retainer 14 away from the fence can have beveled surfaces (not shown) to facilitate insertion of the retainer.

After insertion the lower fence end 28 is pressed against the putting green 34 and extends along the top surface of the putting green. The fence face 26 faces the golf hole 34 to intercept golf balls from missed putts. The illustrated fence face 26 extends away about the width of two golf holes from each side of the golf hole 32 along the fence's chord width.

In use, golf balls being putted towards the golf hole are putted towards the fence face 26 and are received within the relatively wide included angle 25*a*. Because the fence 26 extends in a straight-line direction more than the diameter of the golf hole beyond each side of the golf hole, a relatively large percentage of missed putts will strike the fence 12. The impact force of the golf ball striking the fence 12 is transmitted from the fence 12, through the rail 16, to the retainer 14, and then to ground through the wall of the golf hole. The curvature of the fence 12 causes the golf ball to rebound generally towards the golf hole 34, and the rebound may find the golf ball falling into the golf hole.

Removal of the golf training aid 10 is simply a matter of pulling up on the fence 12 to remove the retainer 14 from the golf hole. The retainer 14 slips out of the golf hole without damaging the golf hole or the golf cup.

Figure 6:
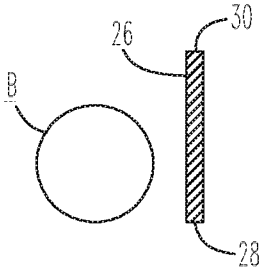
FIGS. 5 and 6 illustrate cross-sections of variant embodiments of the fence of the first embodiment golf training aid.
Figure 5:
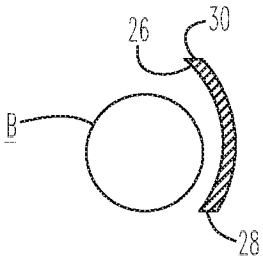
Figure 9:
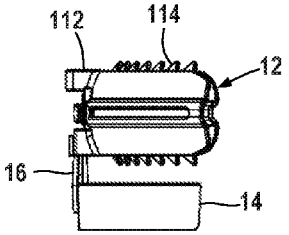
FIGS. 7-9 are front, top, and side views respectively of a second embodiment golf training aid in a compact condition.
Figure 8:
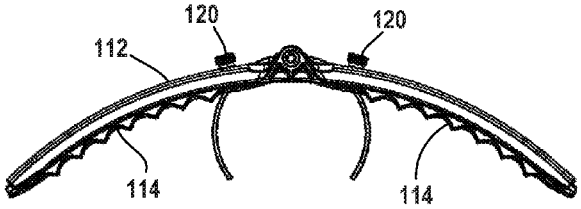
Figure 7:
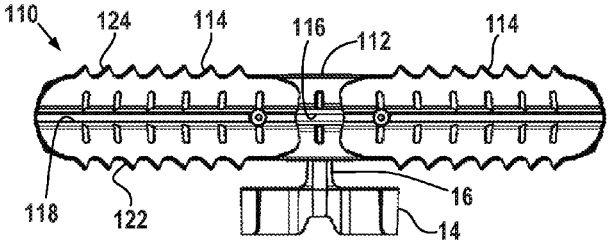
Figure 10:
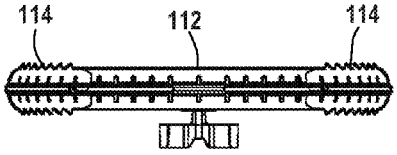
FIGS. 10 and 11 show the second embodiment golf training aid in an extended condition.
Figure 11:
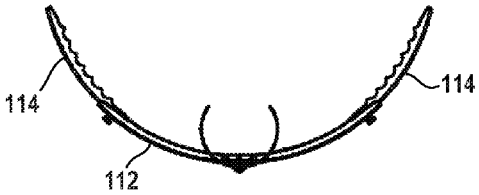

FIGS. 5 and 6 illustrate two variant embodiments of the fence 12. In the FIG. 5 embodiment, the fence 12 has a concave face 26 that extends in the height direction from the lower fence end 28 to the upper fence end 30. The radius of curvature of the face 22 is slightly greater than the radius of a regulation golf ball B.

In the FIG. 6 embodiment, the fence 12 has a flat face 26 that is substantially perpendicular to the putting surface in use.

FIGS. 7-11 illustrate a second embodiment golf training aid 110. The golf training aid 110 is similar to the golf training aid 10 and so the same reference numerals will be used for corresponding elements.

The fence 12 is an adjustable-width fence having a concave cross-section as the fence shown in FIG. 5. The fence 12 includes a fixed fence portion 112 attached to the rail 16 and a pair of curved, elongate arms 114 that slide along the fixed fence portion 112. The curvature of the arms 114 conforms with the curvature of the fence portion 112 to enable the arms 114 to slide along the fence 112 from retracted positions shown in FIGS. 7-9 in which the arms 114 do not extend beyond the ends of the fixed fence 112 to extended positions shown in FIGS. 10 and 11 in which the ends of the arms 114 define the ends of the fence 12.

Horizontal slots 116 in the fence portion 112 and horizontal slots 118 in each arm 114 contain nut/bolt pairs 120 to enable positioning of the arms 114 and removal of the arms 114 from the fence portion 112 if desired. Other constructions to fix the position of the arms 114 with respect to the fence portion 112 are known and can be used in other embodiments of the golf training aid.

The bottom and top sides 122, 124 of the arms 114 are serrated to enable the serration points of the lower side of the arms 114 to extend into the putting green and assist in securing the device 110 during use. Both sides 122, 124 of the arms 114 are serrated so that the arms 114 can be interchangeably mounted to the fence 112 with a serrated side being the lower side.

While multiple embodiments have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

What is claimed is:

1. A golf training aid for practicing putting on a putting surface having a regulation-sized golf hole defined by an annular wall having a diameter, the training aid comprising:

a retainer and a fence;

the retainer being sized to be closely received into the golf hole and placed in a playing position inside the golf hole;

the fence comprising a curved face having a width dimension and a height dimension perpendicular to the width dimension, the face being concave and curved along the width dimension from a first point on a first end of the fence, through a second point along the fence, and to a third point on a second end of the fence, the first, second, and third points defining a circle having a diameter greater than the diameter of the golf hole;

when the retainer is in the playing position, the fence is against the putting surface with the height dimension of the fence face extending away from the putting surface and the width dimension of the fence face extending away from opposite sides of the golf hole whereby a golf ball putted toward the fence face that misses the golf hole strikes the fence face; and wherein the fence comprises a stationary portion and a first panel movable with respect to the stationary portion, the first panel movable to vary the angle subtended by the fence face.

2. The golf training aid of claim 1 wherein the fence comprises a second panel movable with respect to the stationary portion, the first and second panels mounted on opposite end portions of the stationary portion.

3. The golf training aid of claim 1 wherein the stationary portion of the fence comprises a first end portion and an opposite second end portion, the first panel being attached to the first end portion; and the fence comprises a second panel attached to the second end portion, the second panel movable with respect to the stationary portion, the second panel movable to vary the angle subtended by the fence face.

4. A golf training aid for practicing putting on a putting surface having a regulation-sized golf hole defined by an annular wall having a diameter, the training aid comprising:

a retainer and a fence;

the retainer being sized to be closely received into the golf hole and placed in a playing position inside the golf hole;

the fence comprising a curved face having a width dimension and a height dimension perpendicular to the width dimension, the face being concave and curved along the width dimension from a first point on a first end of the fence, through a second point along the fence, and to a third point on a second end of the fence, the first, second, and third points defining a circle having a diameter greater than the diameter of the golf hole;

when the retainer is in the playing position, the fence is against the putting surface with the height dimension of the fence face extending away from the putting surface and the width dimension of the fence face extending away from opposite sides of the golf hole whereby a golf ball putted toward the fence face that misses the golf hole strikes the fence face;

the retainer being spaced away from the fence; and wherein the fence and retainer are both attached to a rail.

5. A golf training aid for practicing putting on a putting surface having a regulation-sized golf hole defined by an annular wall having a diameter, the training aid comprising:

a retainer and a fence;

the retainer being sized to be closely received into the golf hole and placed in a playing position inside the golf hole;

the fence comprising a curved face having a width dimension and a height dimension perpendicular to the width dimension, the face being concave and curved along the width dimension from a first point on a first end of the fence, through a second point along the fence, and to a third point on a second end of the fence, the first, second, and third points defining a circle having a diameter greater than the diameter of the golf hole;

when the retainer is in the playing position, the fence is against the putting surface with the height dimension of the fence face extending away from the putting surface and the width dimension of the fence face extending away from opposite sides of the golf hole whereby a golf ball putted toward the fence face that misses the golf hole strikes the fence face; and wherein the fence has a lower surface that faces the putting surface when the retainer is inserted into the golf hole, the fence lower surface being a serrated surface.

6. The golf training aid of claim 5 wherein the lower surface of the fence is on a first side of the fence and the fence comprises an upper surface on a second side of the fence opposite the first side, the upper surface being a serrated surface.

* * * * *